US011534755B2

(12) United States Patent
Ning et al.

(10) Patent No.: US 11,534,755 B2
(45) Date of Patent: Dec. 27, 2022

(54) MICRO-CHANNEL DEVICE AND MANUFACTURING METHOD THEREOF AND MICRO-FLUIDIC SYSTEM

(71) Applicant: BOE TECHNOLOGY GROUP CO., LTD., Beijing (CN)

(72) Inventors: Ce Ning, Beijing (CN); Xiaochen Ma, Beijing (CN); Hehe Hu, Beijing (CN); Guangcai Yuan, Beijing (CN); Xin Gu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 109 days.

(21) Appl. No.: 16/755,911

(22) PCT Filed: Apr. 16, 2019

(86) PCT No.: PCT/CN2019/082873
§ 371 (c)(1),
(2) Date: Apr. 14, 2020

(87) PCT Pub. No.: WO2020/210981
PCT Pub. Date: Oct. 22, 2020

(65) Prior Publication Data
US 2021/0220824 A1 Jul. 22, 2021

(51) Int. Cl.
*B01L 3/00* (2006.01)

(52) U.S. Cl.
CPC ... *B01L 3/502707* (2013.01); *B01L 3/502715* (2013.01); *B01L 2200/12* (2013.01); *B01L 2300/0887* (2013.01); *B01L 2300/12* (2013.01)

(58) Field of Classification Search
CPC ..... B01L 3/502707; B01L 3/502715; B01L 2200/12; B01L 2300/0887; B01L 2300/12
See application file for complete search history.

(56) References Cited

U.S. PATENT DOCUMENTS 6,433,356 B1 8/2002 Cahen et al.
2002/0018499 A1 2/2002 Kuniyasu et al.
(Continued)

FOREIGN PATENT DOCUMENTS

AU 2014348306 A1 6/2016
CN 101013083 A 8/2007
(Continued)

OTHER PUBLICATIONS

Su et al. (CN 101592627, examiner provided machine translation) (Year: 2009).*
(Continued)

*Primary Examiner* — Benjamin R Whatley
*Assistant Examiner* — Jean Caraballo-Leon
(74) *Attorney, Agent, or Firm* — WHDA, LLP

(57) ABSTRACT

The present disclosure relates to a micro-channel device. The micro-channel device may include a micro-channel structure and a semiconductor junction. The micro-channel structure may include a base layer, a plurality of rails distributed on the base layer at intervals, and a cover layer comprising a plurality of columns. The cover layer and the base layer are configured to form a plurality of micro-channels. The semiconductor junction may include a P-type semiconductor layer, an intrinsic semiconductor layer and a N-type semiconductor layer stacked in a first direction.

11 Claims, 8 Drawing Sheets

(56) References Cited

U.S. PATENT DOCUMENTS

| | | | | |
|---|---|---|---|---|
| 2005/0014175 | A1 | 1/2005 | Quake | |
| 2007/0151942 | A1 | 7/2007 | Dishongh et al. | |
| 2016/0244714 | A1* | 8/2016 | Spuhler | G01N 15/1484 |
| 2019/0056329 | A1* | 2/2019 | Low | G01N 21/78 |

FOREIGN PATENT DOCUMENTS

| | | | | | |
|---|---|---|---|---|---|
| CN | 101468786 | A | | 7/2009 | |
| CN | 101592627 | A | * | 12/2009 | |
| CN | 101592627 | A | | 12/2009 | |
| CN | 101765766 | A | | 6/2010 | |
| CN | 102150037 | A | | 8/2011 | |
| CN | 102203282 | A | | 9/2011 | |
| CN | 102509728 | A | | 6/2012 | |
| CN | 203445122 | U | | 2/2014 | |
| CN | 106197773 | A | | 12/2016 | |
| CN | 109060922 | A | | 12/2018 | |
| KR | 20050106408 | A | * | 11/2005 | B01L 7/525 |
| WO | 0181896 | A1 | | 11/2001 | |

OTHER PUBLICATIONS

Kistrup et al. (Ultrasonic welding for fast bonding of self-aligned structures in lab-on-a-chip systems, Lab on a Chip, 2015, 15, pp. 1998-2001,) (Year: 2015).*

Lamberti et al. (A Combined Electrochemical-Microfluidic Strategy for the Microscale-Sized Selective Modification of Transparent Conductive Oxides, Advanced Materials Interfaces, 2018, 10 pages (Year: 2018).*

Glick et al. (Fabrication of Double-Sided Microfluidixc Structures via 3D Printed Transfer Molding, Solid-State Sensors, Actuators and Microsystems Workshop, 2016, pp. 153-156) (Year: 2016).*

International Search Report dated Jan. 19, 2020, issued in counterpart application No. PCT/CN2019/082873. (10 pages).

Office Action dated Nov. 27, 2020, issued in counterpart CN Application No. 201980000501.0, with English translation (23 pages).

* cited by examiner

MICRO-CHANNEL DEVICE AND MANUFACTURING METHOD THEREOF AND MICRO-FLUIDIC SYSTEM

TECHNICAL FIELD

The present disclosure relates to micro-fluidic technology, and particularly, to a micro-channel device, a micro-channel system and a method of manufacturing a micro-channel device.

BACKGROUND

Micro-channel structures are of great interest for applications involving manipulation of small volume of fluid such as chemical and biochemical analysis. Various micro-channel structures having channel dimensions on the order of one or a few millimeters have been used for chemical and biochemical assays. Microfluidics emerged in the beginning of the 1980s and have been used in the fields of inkjet printheads, DNA chips, lab-on-a-chip technology, micro-propulsion, and micro-thermal technologies.

BRIEF SUMMARY

In one aspect, the present disclosure provides a micro-channel device. The micro-channel device may include a micro-channel structure and a semiconductor junction. The micro-channel structure may include a base layer, a plurality of rails distributed on the base layer at intervals, and a cover layer comprising a plurality of columns. The cover layer and the base layer are configured to form a plurality of micro-channels. The semiconductor junction may include a P-type semiconductor layer, an intrinsic semiconductor layer and a N-type semiconductor layer stacked in a first direction on a base substrate.

In some embodiments, the plurality of columns and the plurality of rails have a one-to-one correspondence.

In some embodiments, an orthographic projection of one of the plurality of columns on the base layer covers an orthographic projection of a corresponding rail on the base layer.

In some embodiments, each of the plurality of rails extends along a second direction, and the plurality of micro-channels have a same extension direction as the second direction.

In some embodiments, at least one of the plurality of rails has a S-shape, and a corresponding column has the same S-shape.

In some embodiments, the first direction is substantially perpendicular to the base substrate.

In some embodiments, the plurality of columns are made of a transparent conductive material.

In some embodiments, the N-type semiconductor layer is the base layer of the micro-channel structure.

In some embodiments, the cover layer is in physical contact with the N-type semiconductor layer.

In some embodiments, the cover layer is the N-type semiconductor layer; the base layer is the intrinsic semiconductor layer; the plurality of rails are made of the same material as the intrinsic semiconductor layer; and the plurality of micro-channels are between the N-type semiconductor layer and the intrinsic semiconductor layer.

In some embodiments, the cover layer is the N-type semiconductor layer, the plurality of micro-channels are on a side of the N-type semiconductor layer opposite from the intrinsic semiconductor layer.

In some embodiments, the cover layer is in parallel with the first direction; the plurality of rails are on the side surface of the semiconductor junction; and the plurality of micro-channels are between the cover layer and the side surface of the semiconductor junction.

In some embodiments, the rails are made of the same material as the intrinsic semiconductor layer.

In some embodiments, the cover layer is in parallel with the first direction; the plurality of rails are on the side surface of the semiconductor junction; and the plurality of micro-channels are on a side of the cover layer opposite from the semiconductor junction.

In some embodiments, each of the plurality of rails has a distance between approximately 10 nm to 1 μm from an adjacent rail.

In some embodiments, each of the plurality of rails has a height between approximately 10 nm to 300 nm.

In one aspect, the present disclosure provides a micro-fluidic system. The display apparatus includes the micro-channel device described herein.

In another aspect, the present disclosure provides a method of manufacturing a micro-channel device described herein. The method includes forming a micro-channel structure and forming a semiconductor junction. The micro-channel structure may include a base layer, a plurality of rails distributed on the base layer at intervals, and a cover layer comprising a plurality of columns. The cover layer and the base layer are configured to form a plurality of micro-channels. The semiconductor junction may include a P-type semiconductor layer, an intrinsic semiconductor layer and a N-type semiconductor layer stacked in a first direction.

In some embodiments, the forming the micro-channel structure includes patterning the N-type semiconductor layer to form the plurality of rails distributed on a surface of the N-type semiconductor layer.

In some embodiments, the forming the plurality of columns includes sputtering a transparent conductive material on the plurality of rails.

BRIEF DESCRIPTION OF THE DRAWINGS

The subject matter which is regarded as the disclosure is particularly pointed out and distinctly claimed in the claims at the conclusion of the specification. The foregoing and other objects, features, and advantages of the present disclosure are apparent from the following detailed description taken in conjunction with the accompanying drawings in which:

DETAILED DESCRIPTION

Figure 1:
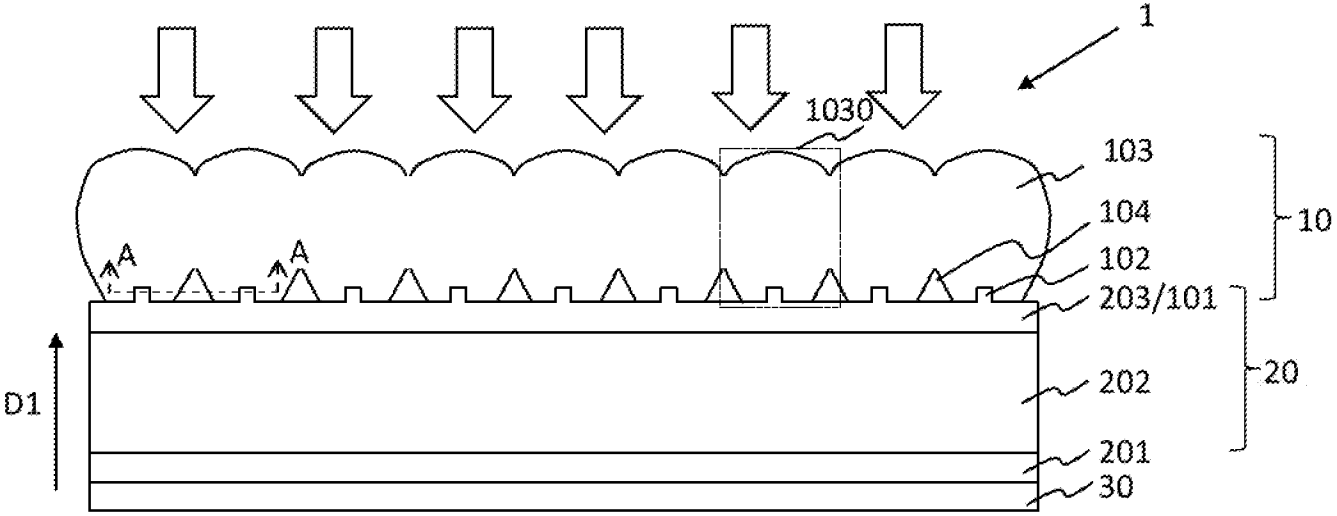
FIG. 1 is a schematic structure of a micro-channel device with micro-channels at the top according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-8. When referring to the figures, like structures and elements shown throughout are indicated with like reference numerals.

Conventional methods for fabricating micro-channel structures involve complicated and expensive processes such as electron beam lithography and laser interference etching, followed by various subsequent etching, lifting, and assembling processes. The conventional methods are associated with high manufacturing costs, low efficiency, and low scalability. Moreover, fabrication of high-resolution or ultra-high-resolution micro-channels using the conventional methods remains difficult.

As used herein, the term "micro-channel" refers to channels having a maximum cross-sectional dimension in the range of approximately 1 nm to approximately 1000 μm, e.g., approximately 1 nm to approximately 50 nm, approximately 50 nm to approximately 100 nm, approximately 100 nm to approximately 1 μm, approximately 1 μm to approximately 10 μm, approximately 10 μm to approximately 100 μm, approximately 100 μm to approximately 200 μm, approximately 200 μm to approximately 400 μm, approximately 400 μm to approximately 600 μm, approximately 600 μm to approximately 800 μm, and approximately 800 μm to approximately 1000 μm. The term "cross-sectional dimension" may relate to height, width and in principle also to diameter. When a wall (including bottom or top of the channel) of the channel is irregular or curved, the terms "height" and "width" may also relate to mean height and mean width, respectively. A micro-channel may have any selected cross-sectional shape, for example, U-shaped, D-shaped, rectangular, triangular, elliptical, oval, circular, semi-circular, square, trapezoidal, pentagonal, hexagonal, etc. cross-sectional geometries. Optionally, the micro-channel has an irregular cross-sectional shape. The geometry may be constant or may vary along the length of the micro channel. Further, a micro-channel may have any selected arrangement or configuration, including linear, non-linear, merging, branching, looped, twisting, stepped, etc. configurations. Optionally, the micro-channel may have one or more open ends. Optionally, the micro-channel may have one or more closed ends. Optionally, the micro-channel has a closed-wall structure. Optionally, the micro-channel has a partially open-wall structure. Optionally, the micro-channel has a fully open-wall structure, e.g., a micro-groove.

One embodiment of the present disclosure provides a micro-channel device. FIG. 1 is schematic structure of a micro-channel device with micro-channels at the top according to one embodiment of the present disclosure. As shown in FIG. 1, the micro-channel device 1 may include a micro-channel structure 10 and a semiconductor junction 20. The micro-channel structure 10 includes a base layer 101, a plurality of rails 102 distributed on the base layer 101 at intervals, and a cover layer 103. The cover layer 103 includes a plurality of columns 1030 connected together. A surface of the cover layer 103 facing the base layer 101 includes a plurality of ridges and a plurality of valleys, which are alternatively distributed. The plurality of ridges is located on the plurality of rails. The cover layer 103 and the base layer 101 are configured to form a plurality of micro-channels 104. That is, the plurality of valleys on the surface of the cover layer 103 facing the base layer 101 and the base layer 101 form the plurality of micro-channels 104. The semiconductor junction 20 includes a P-type semiconductor layer 201, an intrinsic semiconductor layer 202 and a N-type semiconductor layer 203 stacked in a first direction D1, as shown in FIG. 1.

Figure 2:
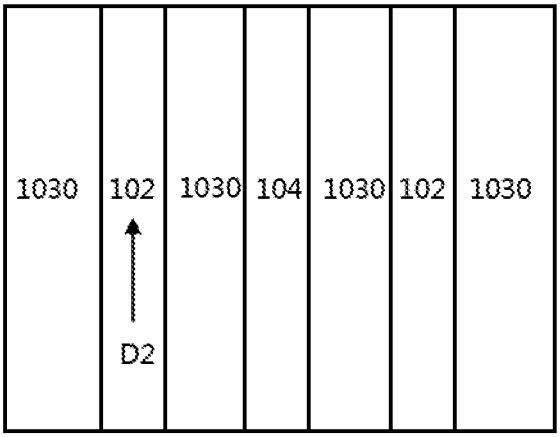
FIG. 2 is an A-A section according to the schematic structure of the micro-channel device in FIG. 1.

In some embodiments, the plurality of columns 1030 and the plurality of rails 102 have a one-to-one correspondence. FIG. 2 is an A-A section according to the schematic structure of the micro-channel device in FIG. 1. As shown in FIG. 2, one of the plurality of the micro-channel 104 is between two of the plurality of columns 1030. An orthographic projection of one of the plurality of columns 1030 on the base layer 101 covers an orthographic projection of a corresponding rail 102 on the base layer 101. In one embodiment, the orthographic projection of the corresponding rail 102 is located in the middle of the orthographic projection of one of the plurality of columns 1030.

Optionally, each of plurality of rails 102 may have any appropriate cross-sectional shape, for example, rectangular, triangular, elliptical, oval, circular, semi-circular, square, trapezoidal, pentagonal, hexagonal, etc. cross-sectional geometries. Optionally, each of plurality of rails 102 has an irregular cross-sectional shape. The geometry may be constant or may vary along the length of the micro channel. Further, each of the plurality of rails 102 may have any selected arrangement or configuration, including linear, non-linear, merging, branching, looped, twisting, stepped, etc. configurations.

Optionally, each of the plurality of rails 102 has a linear shape, and extends along a second direction D2. A corresponding column 1030 and a corresponding micro-channel of the plurality of micro-channels 104 have the same extension directions as the second direction D2, and are parallel to each other. That is, the plurality of rails 102 and the plurality of micro-channels 104 are alternatively distributed in parallel with each other on the base layer 101.

Optionally, at least one of the plurality of rails 102 has a S-shape. The corresponding column 1030 and the corresponding micro-channel of the plurality of micro-channels 104 have the same shapes as the S-shape. That is, the corresponding column 1030 and the corresponding micro-channel of the plurality of micro-channels 104 follow the same shape or contour of the rail 102.

Optionally, the first direction D1 is substantially perpendicular to a base substrate 30. That is, the P-type semiconductor layer 201, the intrinsic semiconductor layer 202 and the N-type semiconductor layer 203 of the semiconductor junction 20 are formed sequentially on the base substrate 30.

Optionally, the cover layer 103 comprising the plurality of columns 1030 is made of a transparent conductive material. The transparent conductive material may include one or more of elements in a group of indium (In), aluminum (Al), gold (Au), silver (Ag) or, indium oxide ($In_2O_3$), tin oxide ($SnO_2$), zinc oxide (ZnO), cadmium oxide (CdO), indium cadmium oxide ($CdIn_2O_4$), cadmium tin oxide ($Cd_2SnO_4$), and zinc tin oxide ($Zn_2SnO_4$).

In some embodiments, as shown in the FIG. 1, the N-type semiconductor layer 203 is the base layer 101 of the micro-channel structure 10. That is, the N-type semiconductor layer 203 of the semiconductor junction 20 and the base layer 101 of the micro-channel structure 10 are the same layer. The N-type semiconductor layer 203 has a plurality of protruding portions on a surface. The plurality of protruding portions is configured as the plurality of rails 102. The cover layer 103 is directly arranged on the plurality of rails 102 or protruding portions, and in physical contact with the N-type semiconductor layer 203. The plurality of micro-channels 104 are at the top of the micro-channel device.

Figure 3:
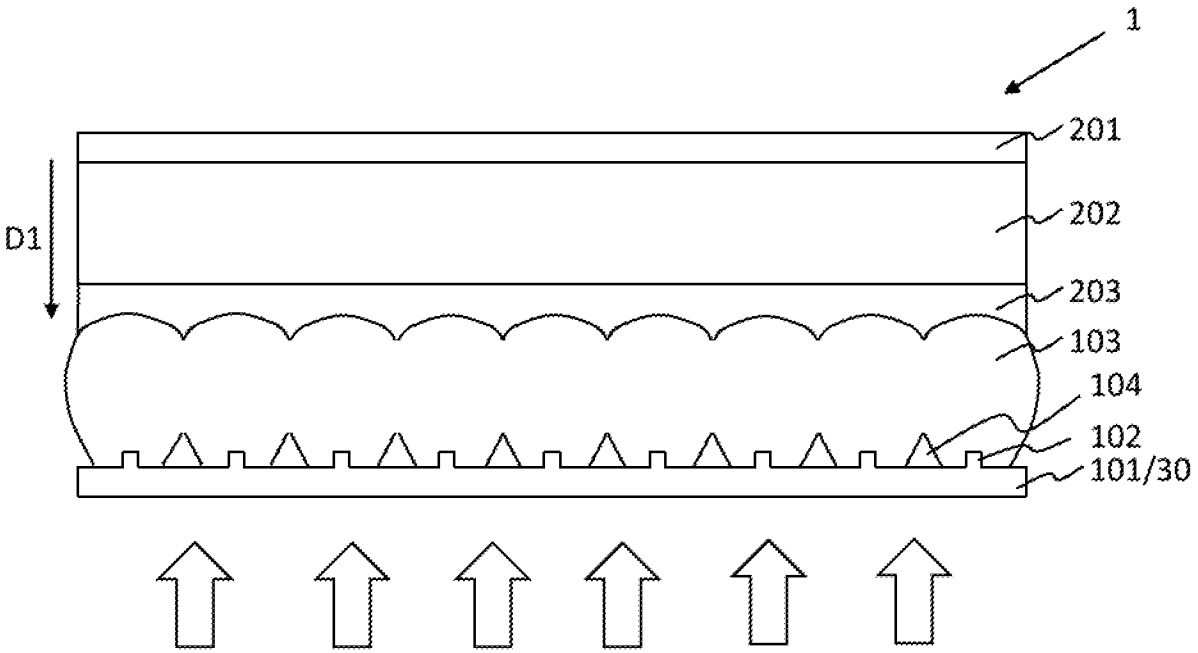
FIG. 3 is a schematic structure of a micro-channel device with micro-channels at the bottom according to one embodiment of the present disclosure.

FIG. 3 is a schematic structure of a micro-channel device with micro-channels at the bottom according to one embodiment of the present disclosure. As shown in the FIG. 3, the base substrate 30 is the base layer 101 of the micro-channel structure 10. That is, the base substrate 30 and the base layer 101 of the micro-channel structure 10 are the same layer. The plurality of rails 102 are formed on the base substrate 30. The semiconductor junction 20 is arranged on a side of the micro-channel structure 10 opposite from the base substrate 30. The plurality of micro-channels 104 are at the bottom of the micro-channel device.

Figure 4:
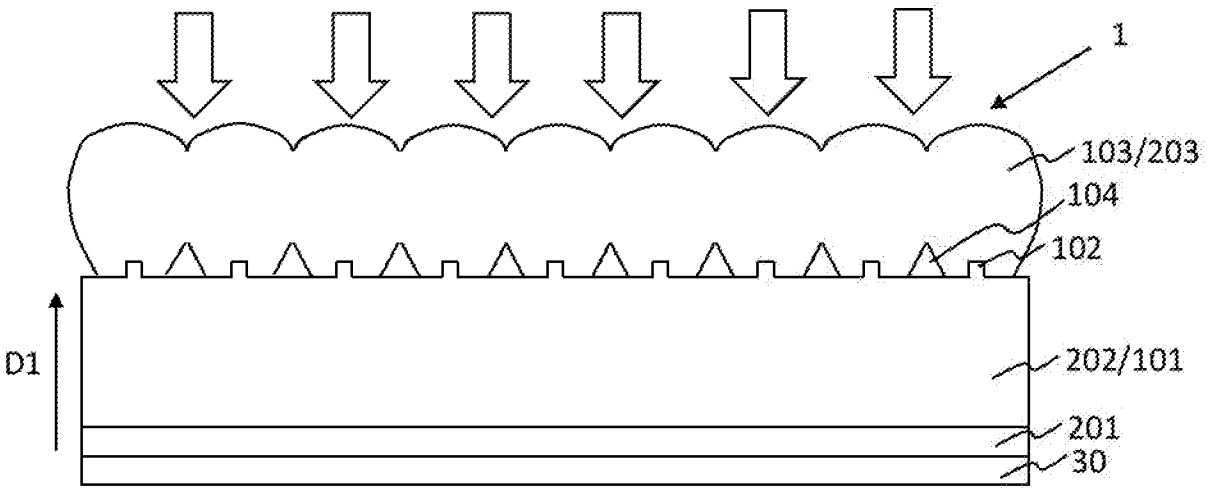
FIG. 4 is a schematic structure of a micro-channel device with micro-channels at the top according to one embodiment of the present disclosure.

FIG. 4 is a schematic structure of a micro-channel device with micro-channels at the top according to one embodiment of the present disclosure. As shown in FIG. 4, the cover layer 103 is the same layer as the N-type semiconductor layer 203; the base layer 101 is the same layer as the intrinsic semiconductor layer 202; the plurality of rails 102 are made of the same material as the intrinsic semiconductor layer 202; and the plurality of micro-channels 104 are formed between the N-type semiconductor layer 203 and the intrinsic semiconductor layer 202. The plurality of micro-channels 104 are at the top of the micro-channel device. In this embodiment, the semiconductor junction 20 and the micro-channel structure 10 are integrated together. That is, the N-type semiconductor layer 203 of the semiconductor junction 20 forms the cover layer 103 of the micro-channel structure 10, and the intrinsic semiconductor layer 202 of the semiconductor junction 20 forms the base layer 101 of the micro-channel structure 10.

Figure 5:
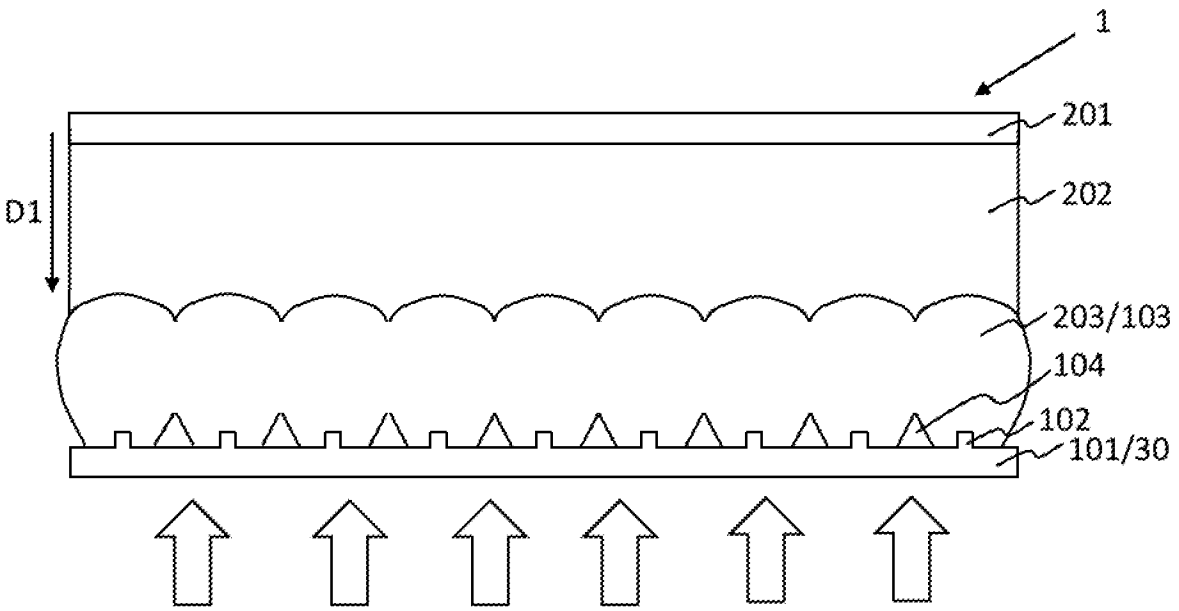
FIG. 5 is a schematic structure of a micro-channel device with micro-channels at the bottom according to one embodiment of the present disclosure.

FIG. 5 is a schematic structure of a micro-channel device with micro-channels at the bottom according to one embodiment of the present disclosure. As shown in FIG. 5, the cover layer 103 is the same layer as the N-type semiconductor layer 203, the plurality of micro-channels 104 are on a side of the N-type semiconductor layer 203 opposite from the intrinsic semiconductor layer 202. The base layer 101 is the same layer as the base substrate 30. The semiconductor junction 20 is arranged on a side of the micro-channel structure 10 opposite from the base substrate 30. The plurality of micro-channels 104 are at the bottom of the micro-channel device.

Figure 6:
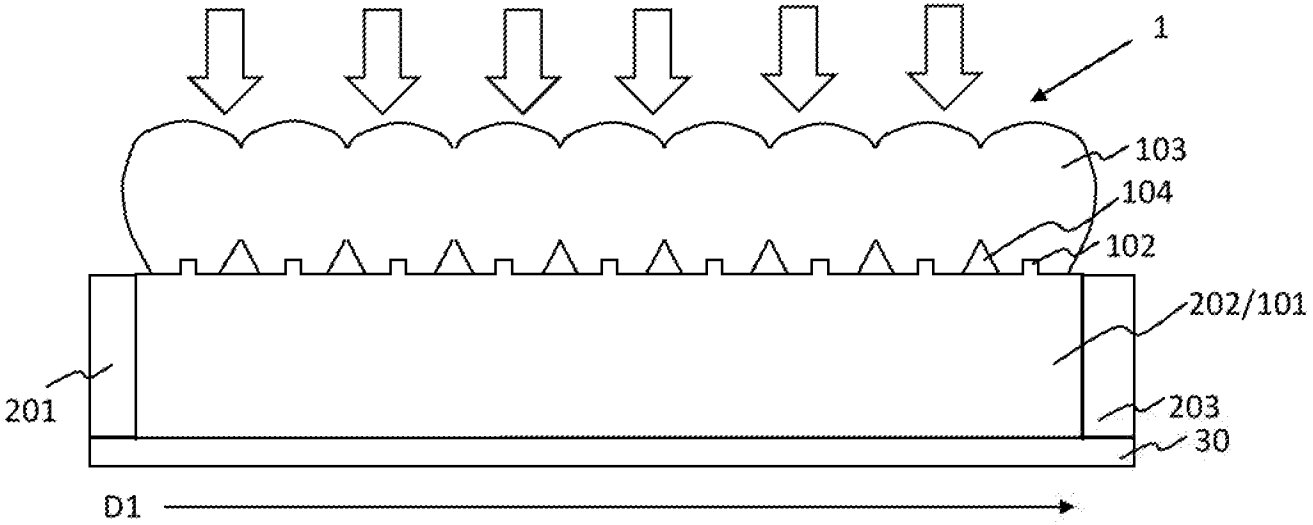
FIG. 6 is a schematic structure of a micro-channel device with micro-channels at the top according to one embodiment of the present disclosure.

FIG. 6 is a schematic structure of a micro-channel device with micro-channels at the top according to one embodiment of the present disclosure. As shown in FIG. 6, the P-type semiconductor layer 201, the intrinsic semiconductor layer 202 and the N-type semiconductor layer 203 are stacked in a first direction D1, and the first direction D1 is parallel to the base substrate 30. The cover layer 103 is in parallel with the first direction D1; the plurality of rails 102 are on a side surface of the semiconductor junction 20 opposite from the base substrate 30; and the plurality of micro-channels 104 are between the cover layer 103 and the side surface of the semiconductor junction 20 opposite from the base substrate 30. The plurality of micro-channels 104 are at the top of the micro-channel device. Optionally, the plurality of rails 102 are arranged on the side surface of the intrinsic semiconductor layer 202 only. Optionally, the plurality of rails 102 are made of the same material as the intrinsic semiconductor layer 202.

Figure 7:
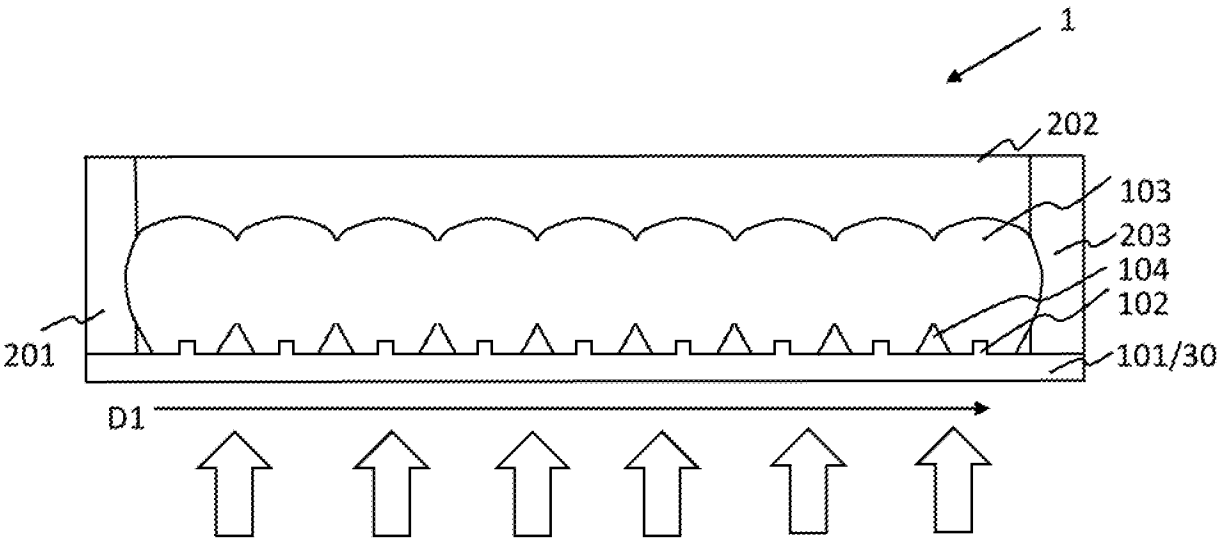
FIG. 7 is a schematic structure of a micro-channel device with micro-channels at the bottom according to one embodiment of the present disclosure.

FIG. 7 is a schematic structure of a micro-channel device with micro-channels at the bottom according to one embodiment of the present disclosure. As shown in FIG. 7, the P-type semiconductor layer 201, the intrinsic semiconductor layer 202 and the N-type semiconductor layer 203 are stacked in a first direction D1, and the first direction D1 is parallel to the base substrate 30. The cover layer 103 is in parallel with the first direction D1; and the plurality of rails 102 are on a side surface of the semiconductor junction 20 facing to the base substrate 30. The plurality of micro-channels 104 are on a side of the cover layer 103 opposite from the semiconductor junction 20, that is, between the base substrate 30 and the cover layer 103. The plurality of micro-channels 104 are at the bottom of the micro-channel device.

In some embodiments, each of the plurality of rails 102 has a distance between approximately 10 nm to approximately 1 μm from an adjacent rail, for example, approximately 10 nm to approximately 25 nm, approximately 25 nm to approximately 50 nm, approximately 50 nm to approximately 75 nm, approximately 75 nm to approximately 100 nm, approximately 100 nm to approximately 250 nm, approximately 250 nm to approximately 500 nm, approximately 500 nm to approximately 750 nm, or approximately 750 nm to approximately 1 μm. Adjusting the distance between two adjacent rails can be used to control a width of the micro-channel.

In some embodiments, each of the plurality of rails has a height in a range between approximately 10 nm to approximately 300 nm e.g., approximately 10 nm to approximately 25 nm, approximately 25 nm to approximately 50 nm, approximately 50 nm to approximately 75 nm, approximately 75 nm to approximately 100 nm, or approximately 100 nm to approximately 300 nm. Adjusting the height of each of the plurality of rails may help controlling a height of the micro-channel. The width of the micro-channel and the height of the micro-channel determine the size of a droplet that is able to flow along the micro-channel.

Depending on the desired function of the micro-channel device, various appropriate materials may be selected for making the plurality of the rails 102, the cover layer 103 and the base substrate 30 based on physical and chemical characteristics that are desirable for the function of the micro-channel device. Appropriate materials include, but are not limited to, polymeric materials such as silicone polymers (e.g., polydimethylsiloxane and epoxy polymers), polyimides (e.g., commercially available Kapton® (poly(4,4'-oxydiphenylene-pyromellitimide), from DuPont, Wilmington, Del.) and Upilex™ (poly(biphenyl tetracarboxylic dianhydride), from Ube Industries, Ltd., Japan), polycarbonates, polyesters, polyamides, polyethers, polyurethanes, polyfluorocarbons, fluorinated polymers (e.g., polyvinylfluoride, polyvinylidene fluoride, polytetrafluoroethylene, polychlorotrifluoroethylene, perfluoroalkoxy polymer, fluorinated ethylene-propylene, polyethylenetetrafluoroethylene, polyethylene chlorotrifluoroethylene, perfluoropolyether, perfluorosulfonic acid, perfluoropolyoxetane, FFPM/FFKM (perfluorinated elastomer [perfluoroelastomer]), FPM/FKM (fluorocarbon [chlorotrifluoroethylenevinylidene fluoride]), as well as copolymers thereof), polyetheretherketones (PEEK), polystyrenes, poly(acrylonitrile-butadiene-styrene) (ABS), acrylate and acrylic acid polymers such as polymethyl methacrylate, and other substituted and unsubstituted polyolefins (e.g., cycloolefin polymer, polypropylene, polybutylene, polyethylene (PE, e.g., cross-linked PE, high-density PE, medium-density PE, linear low-density PE, low-density PE, or ultra-high-molecular-weight PE), polymethylpentene, polybutene-1, polyisobutylene, ethylene propylene rubber, ethylene propylene diene monomer (M-class) rubber), and copolymers thereof (e.g., cycloolefin copolymer); ceramics such as aluminum oxide, silicon oxide, zirconium oxide, and the like; semiconductors such as silicon, gallium arsenide, and the like; glass; metals; as well as coated combinations, composites (e.g., a block composite, e.g., an A-B-A block composite, an A-B-C block composite, or the like, of any materials described herein), and laminates (e.g., a composite material formed from several different bonded layers of identical or different materials, such as polymer laminate or polymer-metal laminates, e.g., polymer coated with copper, a ceramic-in-metal or a polymer-in-metal composite) thereof.

The present micro-channel device may be used in various appropriate sensors, e.g., a bio-chemical sensor, a gas sensor, a deoxyribonucleic acid (DNA) sensor, a ribonucleic acid (RNA) sensor, a peptide or protein sensor, an antibody sensor, an antigen sensor, a tissue factor sensor, a vector and virus vector sensor, a lipid and fatty acid sensor, a steroid sensor, a neurotransmitter sensor, an inorganic ion and electrochemical sensor, a pH sensor, a free radical sensor, a carbohydrate sensor, a neural sensor, a chemical sensor, a small molecule sensor, an exon sensor, a metabolite sensor, an intermediates sensor, chromosome sensor, and a cell sensor.

Optionally, the micro-channel device maybe applied in a lab-on-chip device. Optionally, the micro-channel device maybe applied in a gene sequencing apparatus. As used herein, the term "micro-fluidic chip" refers to a small device capable of separating molecules using small volumes and/or flow rates. As used herein, the term "lab-on-chip" refers to an integrated chip on which various scientific operations such as reaction, separation, purification, and detection of sample solution are conducted simultaneously. It is possible to perform ultrahigh-sensitivity analysis, ultra-trace-amount analysis, or ultra-flexible simultaneous multi-item analysis by using a lab-on-chip. An example of the lab-on-chip is a chip having a protein-producing unit, a protein-purifying unit, and a protein-detecting unit that are connected to each other via micro-channels.

In this way, the semiconductor junction and the micro-channels are integrated by sharing various specific layers. No bonding process is need, thereby enhancing the alignment between the semiconductor junction and the micro-channels and simplifying the processes. Furthermore, the semiconductor junction may be connected to an anode and a cathode respectively to form a PIN diode as a sensor. As such, when the fluidic sample is flowing and passing through the micro-channels, the PIN diode can be used to detect the fluidic sample to get a position signal and/or a composition signal of the fluidic sample.

Figure 8:
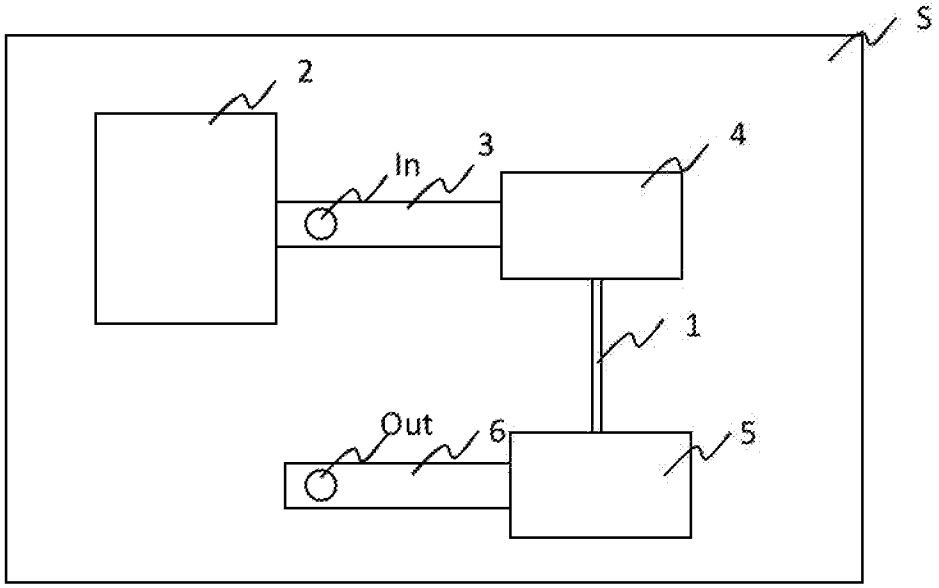
FIG. 8 is a schematic structure of a micro-fluidic system according to one embodiment of the present disclosure.

In one aspect, the present disclosure provides a micro-fluidic system. The micro-fluidic system S includes the micro-channel device 1 described herein according to one embodiment of the present disclosure. FIG. 8 is a schematic structure of a micro-fluidic system according to one embodiment of the present disclosure. Referring to FIG. 8, a fluid sample (e.g., a gas or a liquid) is driven by a flow control device 2 to flow into a first connection channel 3. The flow control device 2 in some embodiments includes one or a combination of electrophoresis, pressure pumps, and other driving mechanisms. Through the first connection channel 3, the fluid sample flows into a first reservoir 4 which is in turn connected to a micro-channel device 1 according to one embodiment of the present disclosure. The first reservoir 4 itself may be a micro-scale channel. The fluid sample then flows into the micro-channel, which controls the transport of the fluid sample in the fluidic chip. Under the control of the micro-channel, the fluid sample flows into a second reservoir 5, a second connection channel 6, and eventually flows out of the fluidic chip.

In another aspect, the present disclosure provides a method of manufacturing a micro-channel device described herein according to one embodiment of the present disclosure. The method includes forming a micro-channel structure and forming a semiconductor junction. The micro-channel structure may include a base layer, a plurality of rails distributed on the base layer at intervals, and a cover layer comprising a plurality of columns. The cover layer and the base layer are configured to form a plurality of micro-channels. The semiconductor junction may include a P-type semiconductor layer, an intrinsic semiconductor layer and a N-type semiconductor layer stacked in a first direction.

In some embodiments, the forming the micro-channel structure includes patterning the N-type semiconductor layer to form the plurality of rails distributed on a surface of the N-type semiconductor layer. Examples of patterning methods for forming the plurality of rails include a photolithography process, an electron beam lithography process, a nanoimprint lithography process, an etching process (e.g., dry etching), a hot corrosion process, or any combination thereof.

In some embodiments, the forming the cover layer comprising the plurality of columns is performed by a deposition method. Examples of appropriate deposition methods include sputtering (e.g., magnetron sputtering) and evaporation coating (e.g., a Chemical Vapor Deposition method, a Plasma-Enhanced Chemical Vapor Deposition (PECVD) method, a thermal vapor deposition method, an atomic layer deposition (ALD) method, and an electron beam evaporation method). Optionally, the cover layer material is deposited by a sputtering method. Optionally, the plurality of columns is formed by sputtering a transparent conductive material on the plurality of rails.

The principle and the embodiment of the present disclosures are set forth in the specification. The description of the embodiments of the present disclosure is only used to help understand the method of the present disclosure and the core idea thereof. Meanwhile, for a person of ordinary skill in the art, the disclosure relates to the scope of the disclosure, and the technical scheme is not limited to the specific combination of the technical features, and also should covered other technical schemes which are formed by combining the technical features or the equivalent features of the technical features without departing from the inventive concept. For example, technical scheme may be obtained by replacing the features described above as disclosed in this disclosure (but not limited to) with similar features.

Reference numbers in the figures:

micro-channel device 1; micro-channel structure 10; base layer 101; rail 102; cover layer 103; column 1030; micro-channels 104; semiconductor junction 20; P-type semiconductor layer 201; intrinsic semiconductor layer 202; N-type semiconductor layer 203; base substrate 30; micro-fluidic system S; flow control device 2; first connection channel 3; first reservoir 4; second reservoir 5; second connection channel 6.

What is claimed is:

1. A micro-channel device, comprising:

a micro-channel structure comprising a base layer, a plurality of rails distributed on the base layer at intervals, and a cover layer comprising a plurality of columns, wherein the cover layer and the base layer are configured to form a plurality of micro-channels, the cover layer covers the plurality of rails, each of the plurality of micro-channels is formed between two adjacent rails, and the plurality of rails and the plurality of micro-channels are arranged alternatively; and a semiconductor junction comprising a P-type semiconductor layer, an intrinsic semiconductor layer and a N-type semiconductor layer, wherein the P-type semiconductor layer, the intrinsic semiconductor layer, and the N-type semiconductor layer are placed together, the base layer and the cover layer are placed together, the micro-channel structure and the semiconductor junction form an integrated structure;

wherein the plurality of columns and the plurality of rails have a one-to-one correspondence, and each of the plurality of columns has a ridge formed at a position corresponding to one of the plurality of rails; and the N-type semiconductor layer is the base layer of the micro-channel structure, the plurality of rails is directly formed on the base layer, the plurality of rails is made of the same material as the base layer, the cover layer is in physical contact with the N-type semiconductor layer, and the cover layer is made of a transparent conductive material.

2. The micro-channel device of claim 1, wherein an orthographic projection of one of the plurality of columns on the base layer covers an orthographic projection of a corresponding rail on the base layer.

3. The micro-channel device of claim 1, wherein each of the plurality of rails extends along a second direction, and the plurality of micro-channels have a same extension direction as the second direction.

4. The micro-channel device of claim 1, wherein at least one of the plurality of rails has a S-shape, and a corresponding column has the same S-shape.

5. The micro-channel structure of claim 1, wherein the P-type semiconductor layer, the intrinsic semiconductor layer, and the N-type semiconductor layer are stacked in a first direction on a base substrate, and the first direction is perpendicular to the base substrate.

6. The micro-channel device of claim 1, wherein a distance between each of the plurality of rails ranges from 10 nm to 1 μm.

7. The micro-channel device of claim 1, wherein each of the plurality of rails has a height between approximately 10 nm to 300 nm.

8. A micro-fluidic system, comprising the micro-channel device of claim 1.

9. A method of manufacturing a micro-channel device, comprising:

forming a micro-channel structure comprising a base layer, a plurality of rails distributed on the base layer at intervals, and a cover layer comprising a plurality of columns: and integrating a semiconductor junction with the micro-channel structure wherein the cover layer and the base layer are configured to form a plurality of micro-channels, the cover layer covers the plurality of rails, each of the plurality of micro-channels is formed between two adjacent rails, and the plurality of rails and the plurality of micro-channels are arranged alternatively;

the semiconductor junction comprises a P-type semiconductor layer, an intrinsic semiconductor layer and a N-type semiconductor layer stacked in a first direction; and the plurality of columns and the plurality of rails have a one-to-one correspondence, and each of the plurality of columns has a ridge formed at a position corresponding to one of the plurality of rails.

10. The method of manufacturing the micro-channel device of claim 9, wherein the N-type semiconductor layer is patterned to form the plurality of rails distributed on a surface of the N-type semiconductor layer, wherein the base layer is the N-type semiconductor.

11. The method of manufacturing the micro-channel device of claim 10, wherein the plurality of columns is formed by sputtering a transparent conductive material on the plurality of rails.

* * * * *